US005641075A

United States Patent [19]

Mechlin

[11] Patent Number: 5,641,075

[45] Date of Patent: Jun. 24, 1997

[54] STORAGE RACK AND METHOD FOR STORING STRING LIGHTING

[76] Inventor: Robert M. Mechlin, 3700 Cardiff Rd., Chevy Chase, Md. 20815

[21] Appl. No.: 520,603

[22] Filed: Aug. 29, 1995

[51] Int. Cl.[6] ..... A47F 5/00

[52] U.S. Cl. ..... 211/26; 206/419; 211/205

[58] Field of Search ..... 211/26, 45, 196, 211/205; 242/588; 206/419, 420

[56] References Cited

U.S. PATENT DOCUMENTS

| | | | |
|---|---|---|---|
| 2,984,347 | 5/1961 | Kalinchuk . | |
| 3,384,227 | 5/1968 | Spatz . | |
| 3,878,941 | 4/1975 | Kelner . | |
| 3,931,887 | 1/1976 | Beck . | |
| 4,022,323 | 5/1977 | Yamazaki . | |
| 4,029,241 | 6/1977 | Krake | 211/196 X |
| 4,917,323 | 4/1990 | Wing . | |
| 4,979,085 | 12/1990 | Voorhees | 211/196 X |
| 5,033,619 | 7/1991 | Garis . | |
| 5,064,067 | 11/1991 | McAllister . | |
| 5,287,965 | 2/1994 | Miller . | |
| 5,381,899 | 1/1995 | Rabbitt | 206/419 X |
| 5,480,036 | 1/1996 | Opar | 211/45 |
| 5,482,226 | 1/1996 | Choate | 206/419 X |

*Primary Examiner*—Robert W. Gibson, Jr.
*Attorney, Agent, or Firm*—Jones, Tullar & Cooper, P.C.

[57] ABSTRACT

A storage rack and method for storing one or more strings of lights is disclosed. The storage rack includes a tubular body having a plurality of slots opening at one end. Light bulbs from a string of lights may be inserted successively into the slots so that the slack in the cord is taken up by the distance between the slots. The light bulbs are located on the interior of the tubular body so that the bulbs are protected from external forces. The rack may be hand-held or mounted on a rotatable base.

18 Claims, 8 Drawing Sheets

STORAGE RACK AND METHOD FOR STORING STRING LIGHTING

FIELD OF THE INVENTION

The present invention is directed generally to a storage rack for use in storing a string of lights, such as Christmas lights. More particularly, the present invention is directed to a storage rack for receiving and retaining a string of lights in a manner such that the light bulbs are protected. Most specifically, the present invention is directed to a storage rack and a method of storing one or more strings of lights in which the light bulbs are protected from external forces and the slack in the wire is generally taken up to prevent tangling.

DESCRIPTION OF THE PRIOR ART

String lighting is a common item used in most households during the holiday seasons for decorating Christmas trees, outdoor shrubbery, house trimming, or the like. String lighting generally embodies an insulated wire cord having a plurality of light bulb sockets mounted along the length of the cord. Light bulbs of various colors are mounted in the bulb sockets, and electrical connectors are located at one or both ends of the cord. Strings of lights having connectors at both ends may be serially connected to form longer strings of lights.

A frequent problem associated with string lighting is the storage and removal from storage of one or more strings of lights. All too often the lights are improperly stored, and one or more of the light bulbs is crushed during storage. Another problem, which may be even more frustrating, is that a string of lights may become tangled either with its own cord, or with the cord of another string, or even with other objects. The correction of these problems can be quite bothersome, and can place a pall on what might otherwise be an happy family event, such as decorating a Christmas tree.

Existing solutions for storing string lighting are inadequate for a variety of reasons. Many people simply wrap the light strings up into a coil, and use the end of the cord to retain the string in the coiled configuration. This method, while quickly accomplished, leaves the bulbs exposed to external forces, and will most likely lead to tangling of the string when an attempt is made to uncoil the string. This tangling problem is particularly exasperated when a number of serially connected strings are wound into a single coil.

A second common approach is to replace the strings into their original packaging. However, these packages are usually molded plastic trays insertable into paperboard boxes, and are optimally configured for display purposes rather than storage. Reinserting a mass of disorganized light strings into the correct plastic trays in an organized manner, and then inserting the plastic trays into their correct boxes can turn into a time consuming and frustrating task. Moreover, even if the lights are properly placed into the original container, there is still the possibility that tangling will occur upon the subsequent removal of the lights the following season.

Numerous attempts have been made to make the task of storing string lighting easier and more convenient. However none of the prior art solutions adequately combine the desirable features of protecting the light bulbs, preventing tangling of the cord, and providing an ease of use in both storage and removal from storage of light strings in a simple and inexpensive design.

It will be apparent that a need exists for an inexpensive and easy to use device and method for storage of string lighting. The storage rack should protect the light bulbs from damage, while also preventing tangling of the cord. The storage rack and method in accordance with the present invention provides these and other advantages, and overcomes the limitations of the prior storage devices for string lighting.

SUMMARY OF THE INVENTION

It is an object of the present invention to provide a storage rack and method for storing string lighting which is easy to use.

Another object of the present invention is to provide a storage rack and method for storing string lighting which protects the light bulbs from damage.

An additional object of the present invention is to provide a storage rack and method for storing string lighting which prevents tangling of the cord.

A further object of the present invention is to provide a storage rack and method for storing string lighting which is inexpensive and easily assembled.

Yet another object of the present invention is to provide a storage rack and method of storing string lighting which can accommodate different strings of lights having varied bulb sizes or distances between bulbs.

An additional object of the present invention is to provide a storage rack and method of storing string lighting which can accommodate multiple strings of light on a single rack.

A further object of the present invention is to provide a storage rack which is free-standing and which includes a rotatable base for ease of use.

As will be discussed in detail in the description of the preferred embodiment which is set forth subsequently, the light string storage rack in accordance with the present invention has a tubular body mounted for rotation on a base. The tubular body includes a plurality of slots for receiving the bulbs of a string of lights. The slack in the cord is taken up by the distance between the slots. The bulbs slide into the interior of the tubular body, and are thus protected from damage. The base enables the storage rack to stand upright on the ground so that a person can have both hands free while loading or unloading light strings. The storage rack is able to accommodate light strings of different types and sizes, and still effectively take up the slack in the cords. A hand-held version of a storage rack without a base is also disclosed.

The light string storage rack in accordance with the present invention overcomes the limitations of the prior light string storage devices by protecting the light bulbs, preventing tangling of the cord, and providing an ease of use in both storage and removal from storage of light strings in a simple and inexpensive design. Thus, it is evident that the storage rack and method for storing string lighting of the present invention provide a substantial advance in the art.

BRIEF DESCRIPTION OF THE DRAWINGS

While the novel features of the method and apparatus in accordance with the present invention are set forth with particularity in the appended claims, a full and complete understanding of the invention may be had by referring to the detailed description of the preferred embodiment which is set forth subsequently, and as illustrated in the accompanying drawings in which:

DESCRIPTION OF THE PREFERRED EMBODIMENT

Figure 1:
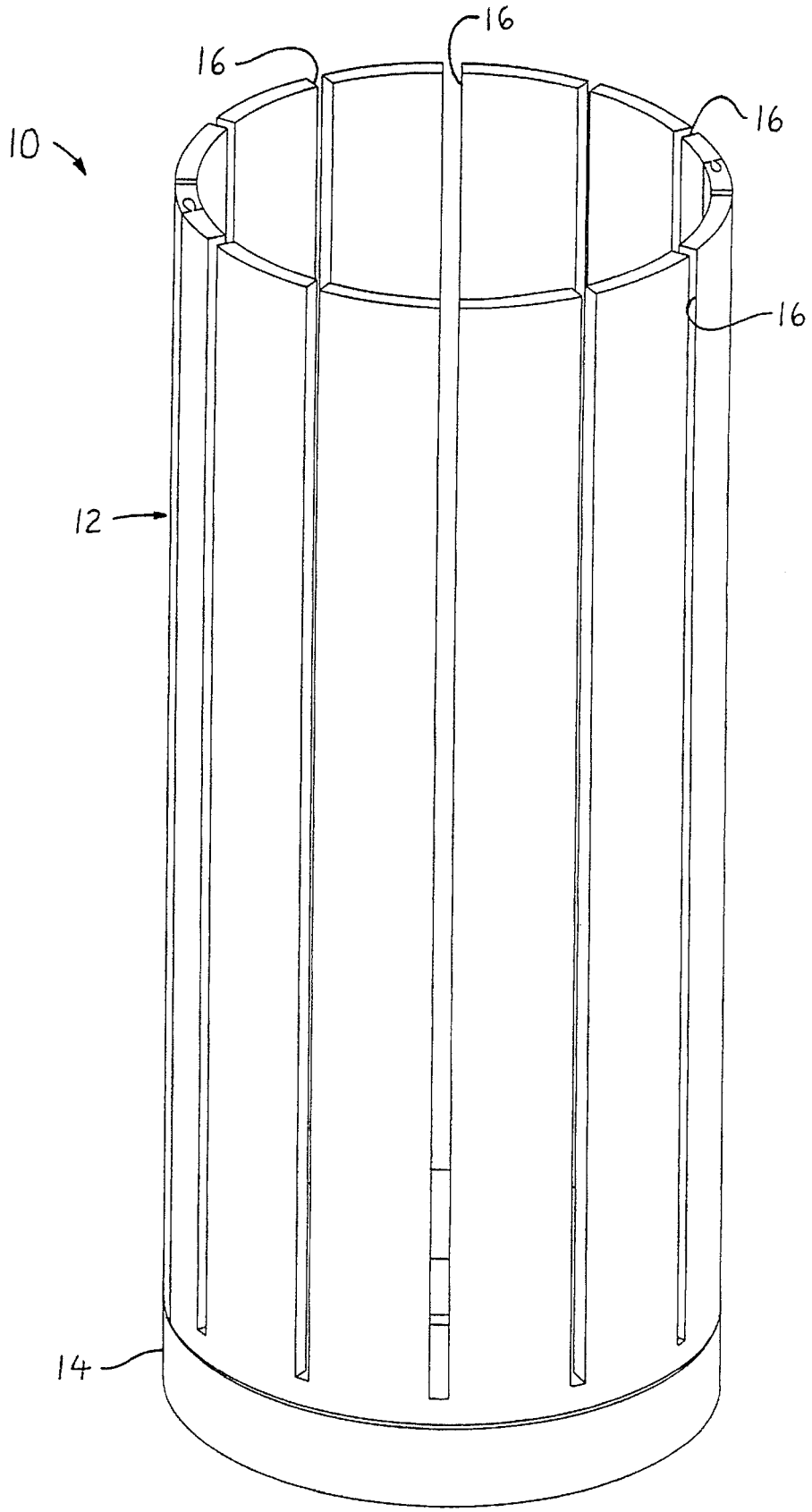
FIG. 1 is a perspective view of a storage rack constructed in accordance with the present invention.
Figure 3:
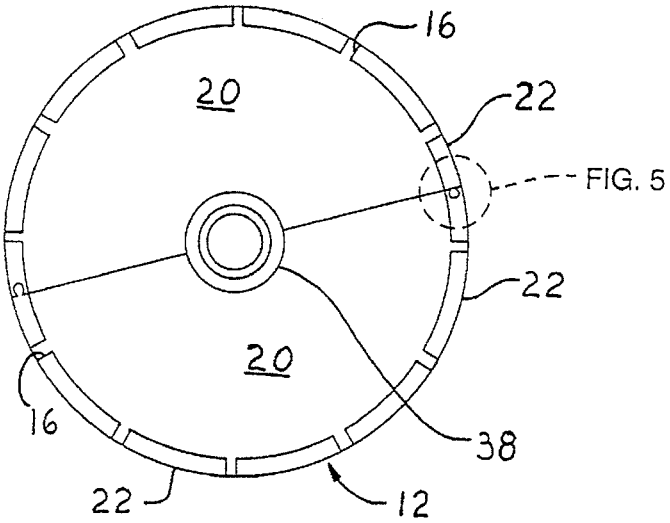
FIG. 3 is a top view of the storage rack of FIG. 1.
Figure 2:
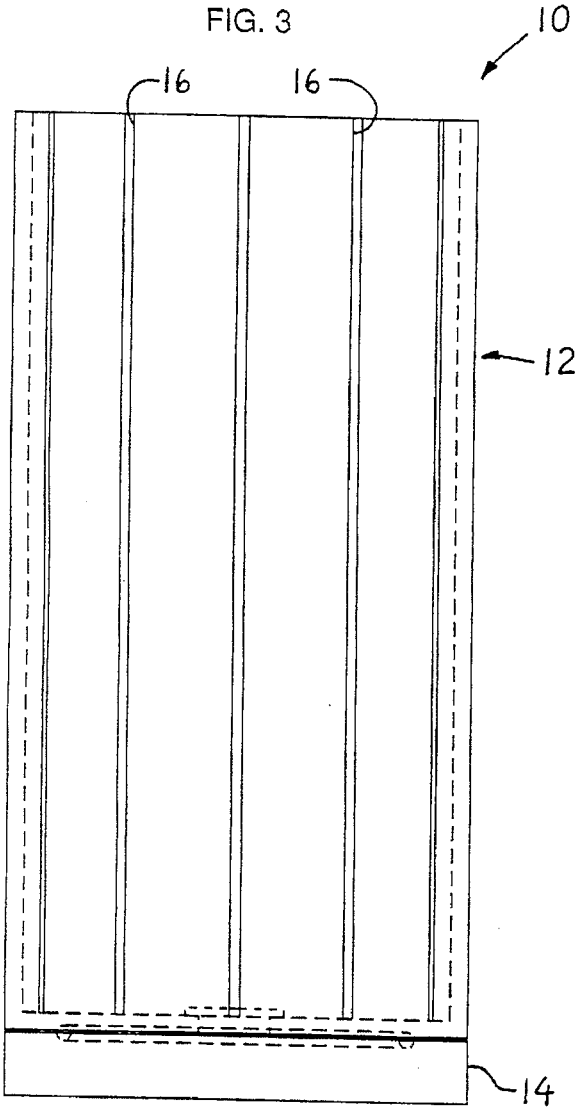
FIG. 2 is a front elevation view of the storage rack of FIG. 1.

Referring initially to FIG. 1, there is illustrated generally at 10 a perspective view of a preferred embodiment of a storage rack for string lighting in accordance with the present invention. As also illustrated in FIGS. 2 and 3, storage rack 10 includes a tubular body or rack portion 12 for receiving one or more strings of lights, and a circular base portion 14 upon which rack portion 12 is mounted for rotational movement. Rack portion 12 has a plurality of longitudinal slots 16 for receiving light bulbs of a string of lights in a manner which will be described in more detail below.

Figure 4:
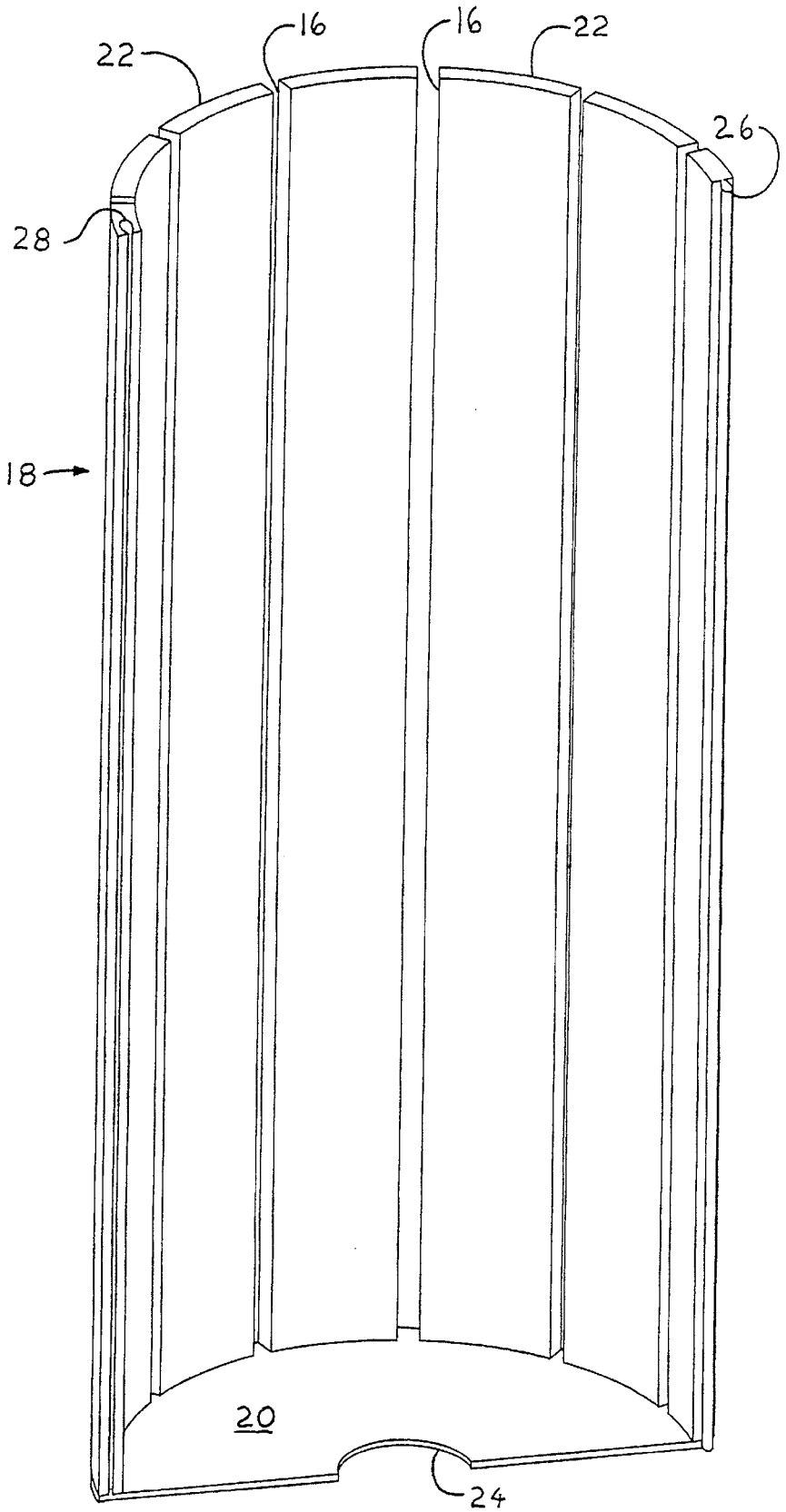
FIG. 4 is a perspective view of a rack half of the storage rack of FIG. 1.

Rack portion 12 is preferably constructed from two generally identical rack halves 18 which may be molded from plastic or constructed from other suitable materials. FIG. 4 shows a perspective view of a rack half 18. Rack half 18 includes a bottom wall 20 which may be molded unitary with a tubular wall 22. Tubular wall 22 is formed with a plurality of longitudinal slots 16 for receiving one or more strings of lights. Bottom wall 20 includes a semi-circular hole 24. When two rack halves 18 are assembled to form a complete rack portion 12, two semicircular holes 24 join to form a central opening in bottom wall 20 which serves for mounting rack portion 12 on base portion 14.

Figure 6:
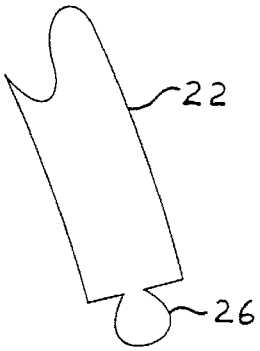
FIG. 6 shows the joint between two rack halves prior to joining.
Figure 6:
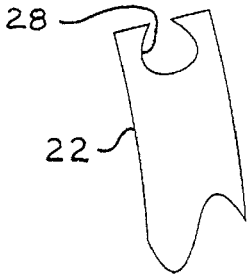
Figure 5:
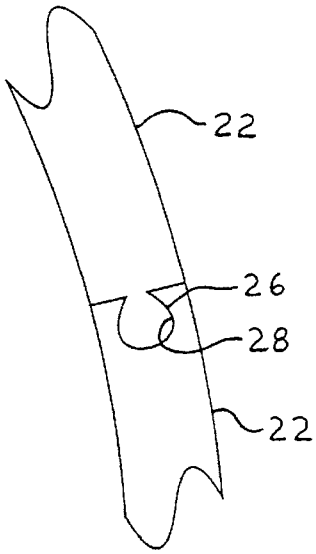
FIG. 5 is an enlarged view of the joint between two rack halves.

For assembling two rack halves 18 together, each rack half 18 is equipped with a longitudinal projection 26 on one mating edge, and a matching projection-receiving slot 28 on the opposite mating edge. As illustrated in FIGS. 5 and 6, projection 26 on a first rack half 18 fits within projection-receiving slot 28 on a second rack half 18, either by snapping into place, or by sliding into place. Other means may also be used for connecting two rack halves 18, so long as the two halves are securely connected. It is also possible to form rack portion 12 as a single unit, rather than from two halves.

Figure 8:
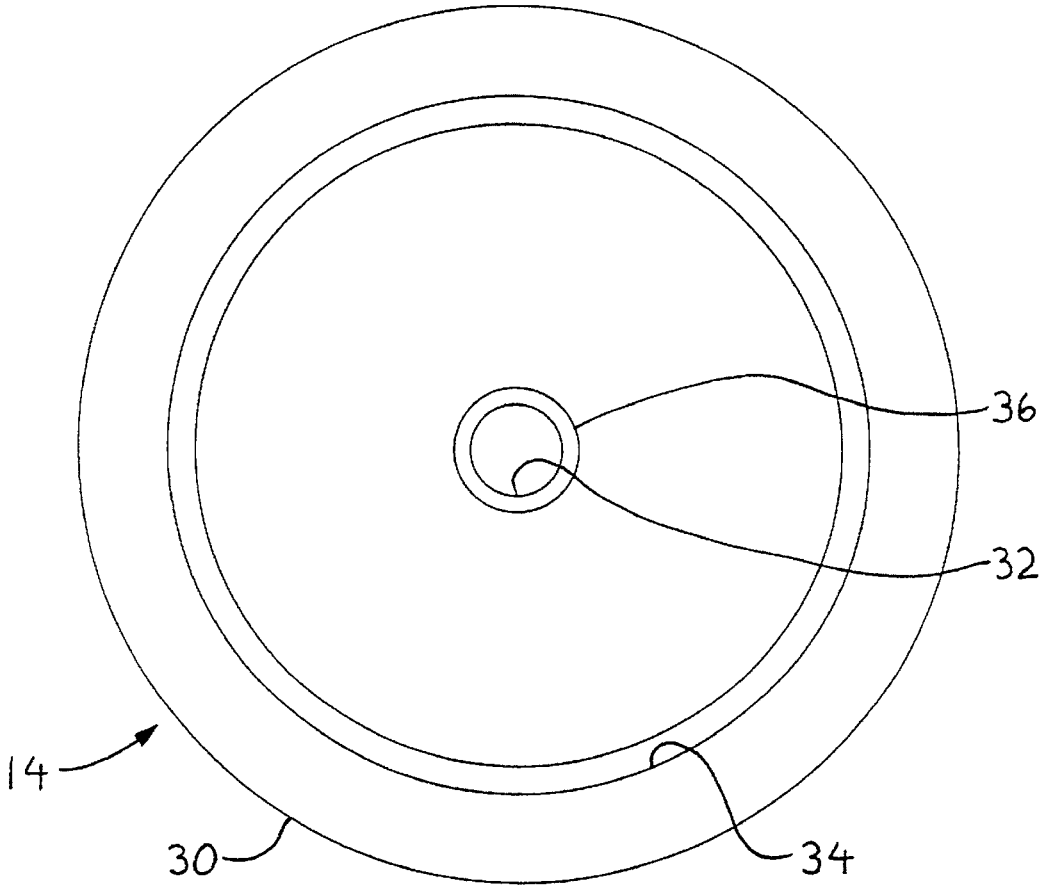
FIG. 8 is a top view of the base of FIG. 7.
Figure 7:
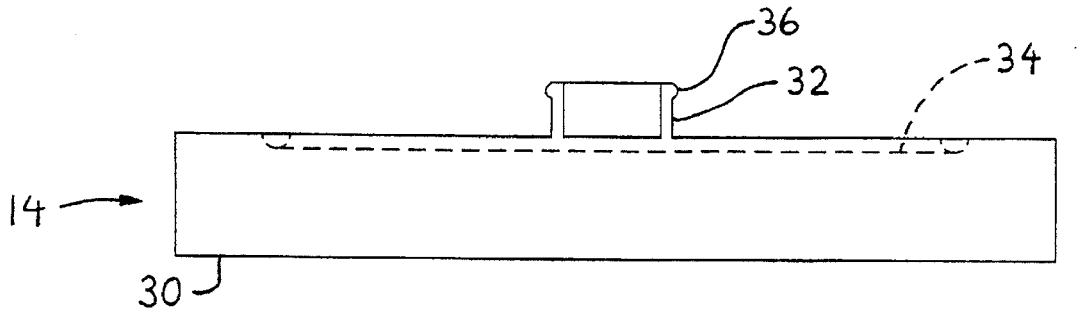
FIG. 7 is a side view of the base of FIG. 2.

As mentioned above, rack portion 12 may be mounted for rotating movement on base portion 14. As illustrated in FIGS. 7 and 8, base portion 14 includes a circular base plate 30 having a cylindrical mounting stub 32 located at the center of its upper surface. Base plate 30 is preferably molded of plastic, but may be constructed from other suitable materials by other suitable means. Base plate 30 also has an annular groove 34 on its upper surface for receiving and retaining ball bearings (not shown), which may be included for reducing the friction between base portion 14 and rack portion 12 when rack portion 12 is being rotated. The ball bearings are contained within groove 34, and when rack portion 12 is installed on base 14, bottom wall 20 rides on the ball bearings and prevents them from escaping from groove 34. In addition, while ball bearings or other friction reducing means are preferably used to provide a low-friction interface between rack portion 12 and base portion 14, the friction reducing means may be eliminated and rack portion 12 will still be able to rotate on base portion 14.

Figure 9:
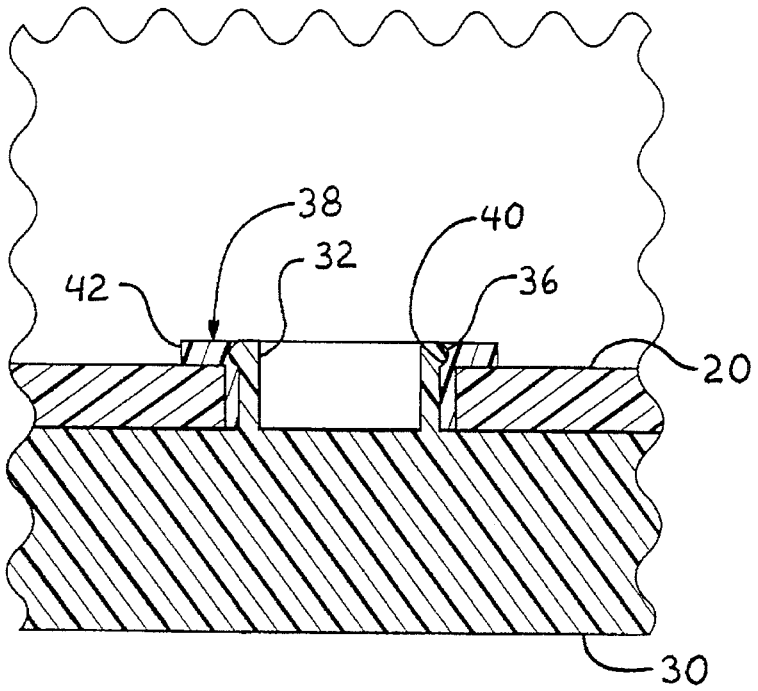
FIG. 9 is a cross-sectional view taken along line 9—9 shown on FIG. 3.
Figure 10:
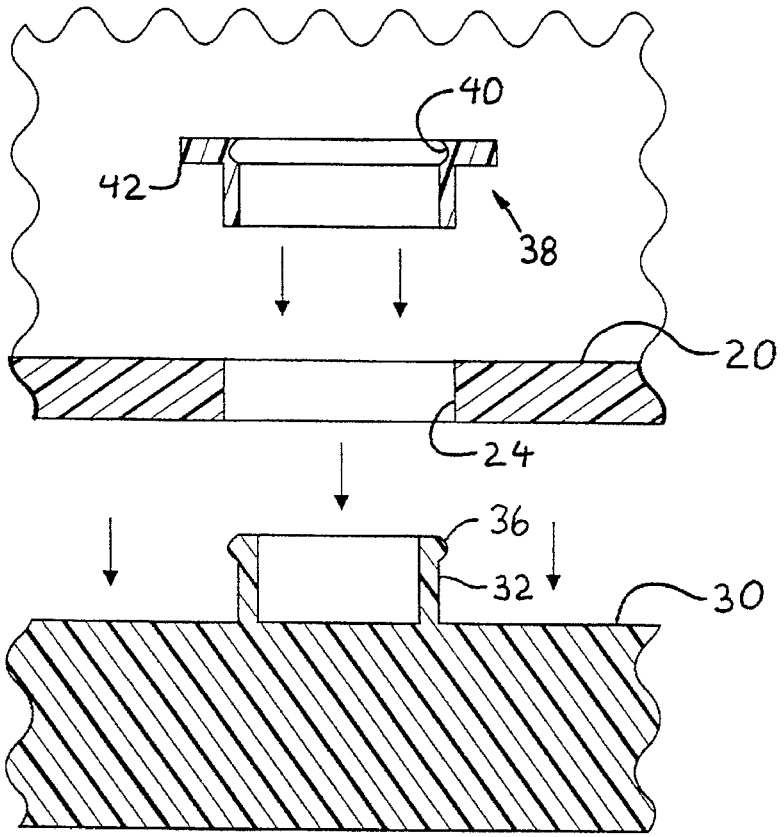
FIG. 10 is an exploded view of the assembly of FIG. 9.

FIG. 9 illustrates a cross-sectional view showing how rack portion 12 is assembled to base portion 14, with FIG. 10 being an exploded view of FIG. 9. Mounting stub 32 is provided with an enlarged-diameter protrusion 36 which acts as a retainer. A cap 38 is provided for snapping into place over mounting stub 32 within hole 24 of bottom wall 20 of rack portion 12. Cap 38 includes a grooved recess 40 for receiving retaining protrusion 36, thus securely retaining cap 38 on mounting stub 32. Cap 38 includes a flange 42 which retains bottom wall 20 of rack portion 12, thereby retaining rack portion 12 on base portion 14 with sufficient clearance to permit rotational movement. It may be seen from this mounting arrangement that rack portion 12 is free to rotate about its longitudinal axis, but is restrained from movement in other directions by cap 38 and mounting stub 32.

Figure 11:
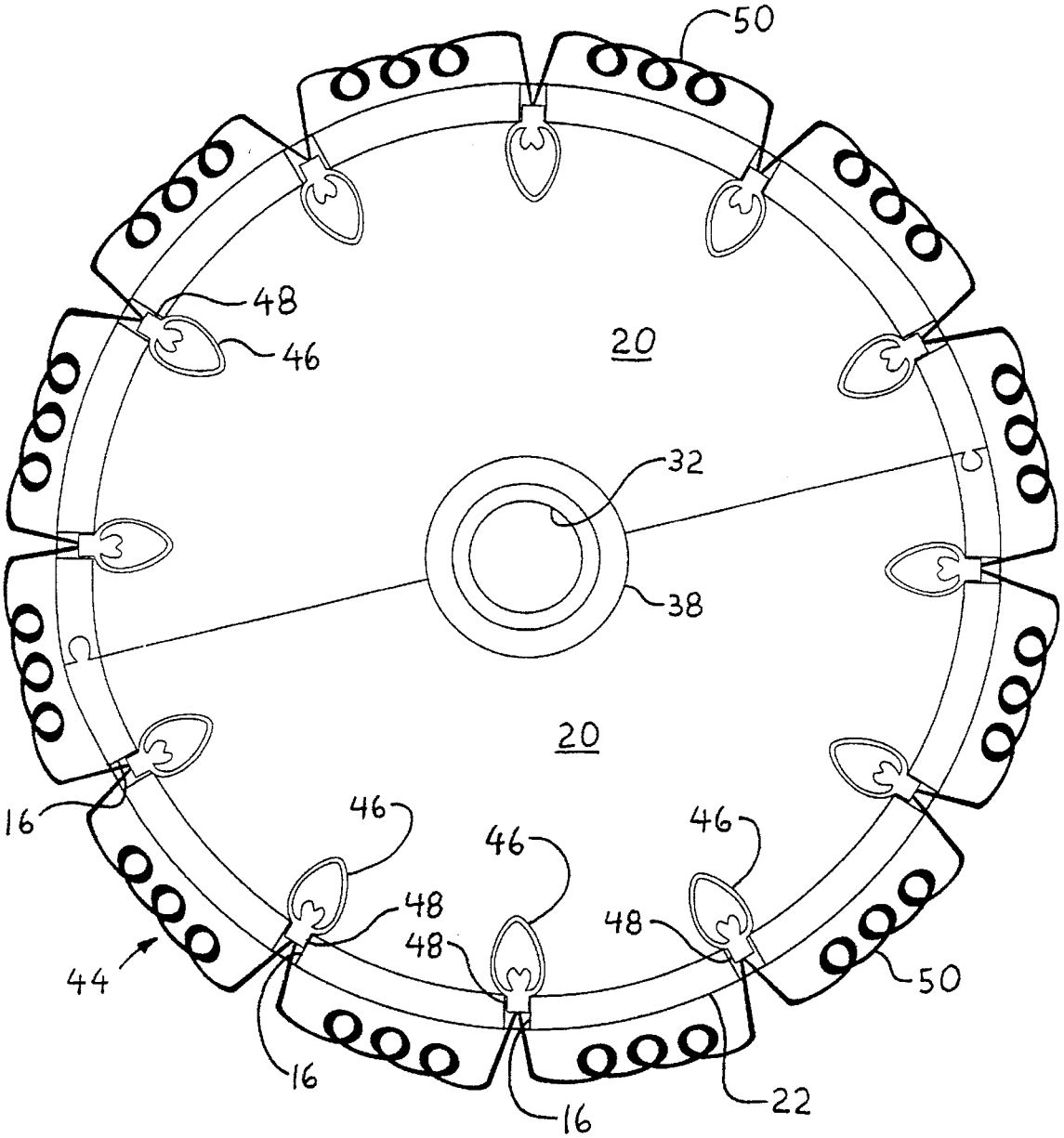
FIG. 11 is a top view of the rack of FIG. 1, showing a method of installing string lighting.

Storage rack 10 may be used to store one or more strings of lights by successively placing the light bulbs into slots 16. FIG. 11 illustrates an exemplary method for mounting string lighting upon storage rack 10. A light string 44 is shown which includes a plurality of light bulbs 46 and sockets 48 mounted on a cord 50. Light bulbs 46 and sockets 48 are slid into longitudinal slots 16, with a first bulb 46 and socket 48 being inserted into a first slot 16, and with the next bulb 46 and socket 48 on light string 44 being inserted into the next slot 16 in rack 10, and so forth, until all of the light bulbs 46 have been mounted on rack portion 12. Rack portion 12 may be rotated as bulbs 46 are installed so that it is not necessary to move around storage rack 10 during loading or unloading of light string 44. In this manner, a large number of bulbs 46 may be stored quickly and easily on rack 10.

Since bulbs 46 are located within the interior of the tubular rack portion 12, bulbs 46 are protected from external forces. In addition, as cord 50 is extended through slots 16 to the exterior of rack portion 12 and then to the next succeeding slot 16, the slack in cord 50 is taken up by the distance between the successive slots 16, thereby reducing the risk of tangling. Removal of light string 44 from rack 10 is accomplished by reversing the loading procedure.

Figure 12:
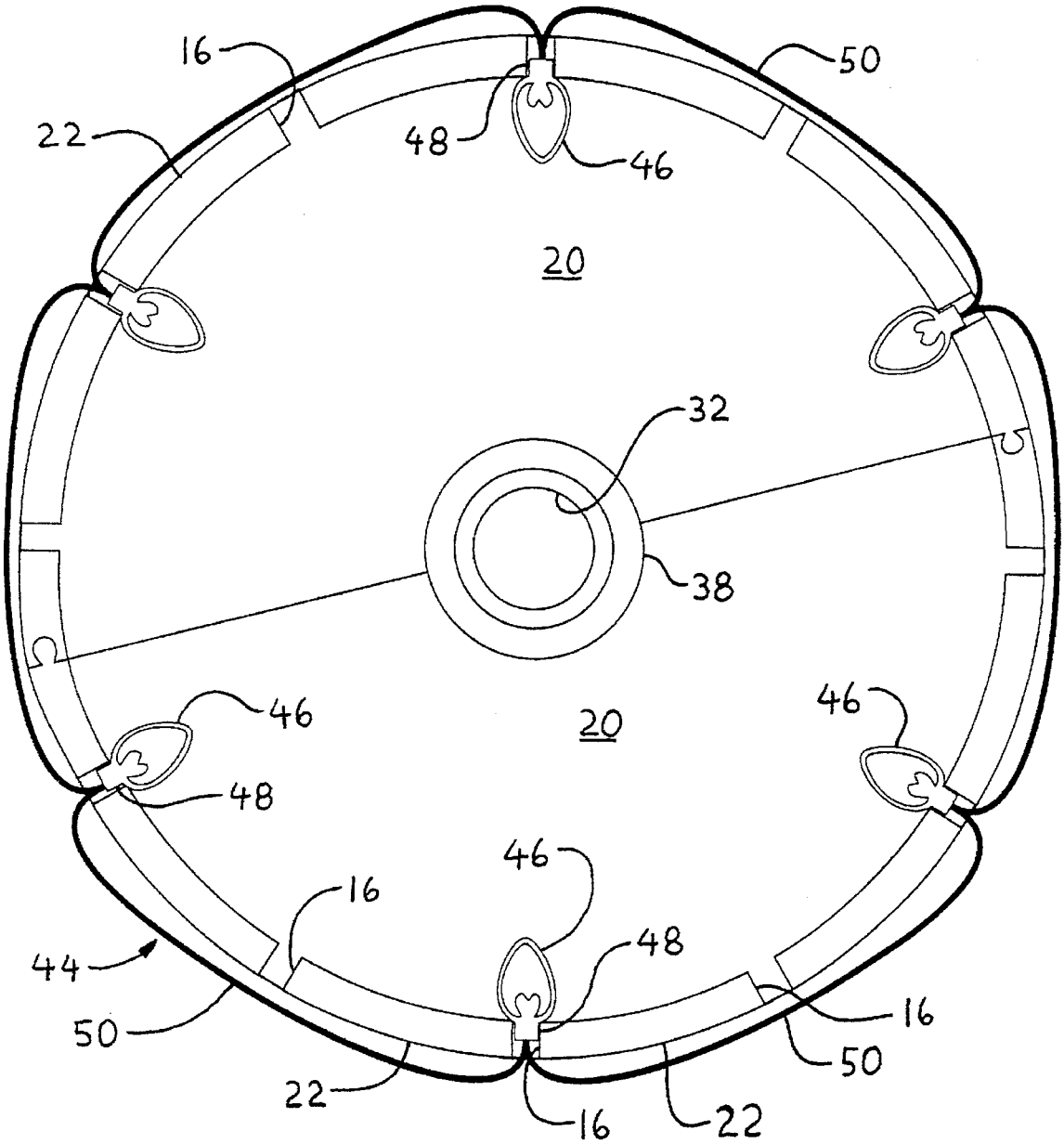
FIG. 12 is a top view of the rack of FIG. 1, showing a variant method of installing string lighting.

FIG. 12 shows a variant method of mounting light string 44 on rack 10 whereby almost all of the slack in cord 50 may be taken up. In FIG. 12, rather than placing the next successive bulb 46 in the next immediate slot 16, the slack in cord 50 is taken up to an even greater extent by skipping one or more slots 16 and placing next bulb 46 in the closest slot 16 which takes up the greatest amount of slack in cord 50. In this manner, not only are bulbs 46 protected from external forces, but virtually all of the slack in cord 50 may be taken up by the distance between slots 16. In addition, slots 16 on rack portion 12 could be spaced a specified distance for a particular string of lights whereby the distance between the slots takes up the desired amount of slack in the cord. Thus it may be seen that the design of the present invention gives an unprecedented flexibility to the user when storing a string of lights, enabling the user to decide how much slack to leave in cord 50 between slots 16.

Moreover, slots 16 are shown to be of a width in which sockets 48 fit within slots 16, while bulbs 46 are too large to pass through slots 16. It may be preferable in some applications, however, to size slots 16 to be even narrower, whereby they are only large enough to permit cord 50 to pass through. In this manner, light strings of the type in which the bulb is narrower than the socket may also be stored on storage rack 10. The entire bulb 46 and socket 48 would then be located in the interior of rack portion 12, with cord 50 extending out slots 16 to the exterior of rack portion 12, and passing from one slot to the next around the external surface of rack portion 12. In this manner, a variety of different-sized light strings having bulbs and sockets of different sizes and shapes, and having different lengths of cord between the bulbs, may be stored on a single storage rack 10.

In addition, it will be apparent that tubular rack portion 12 may be of a variety of shapes other than cylindrical, and base 14 may be other than circular. For example, rack portion 12 may be octagonal, having eight side walls, with a slot at each junction of the side walls. Alternatively, rack portion 12 may be of any other convenient tubular shape having a plurality of longitudinal slots.

Figure 13:
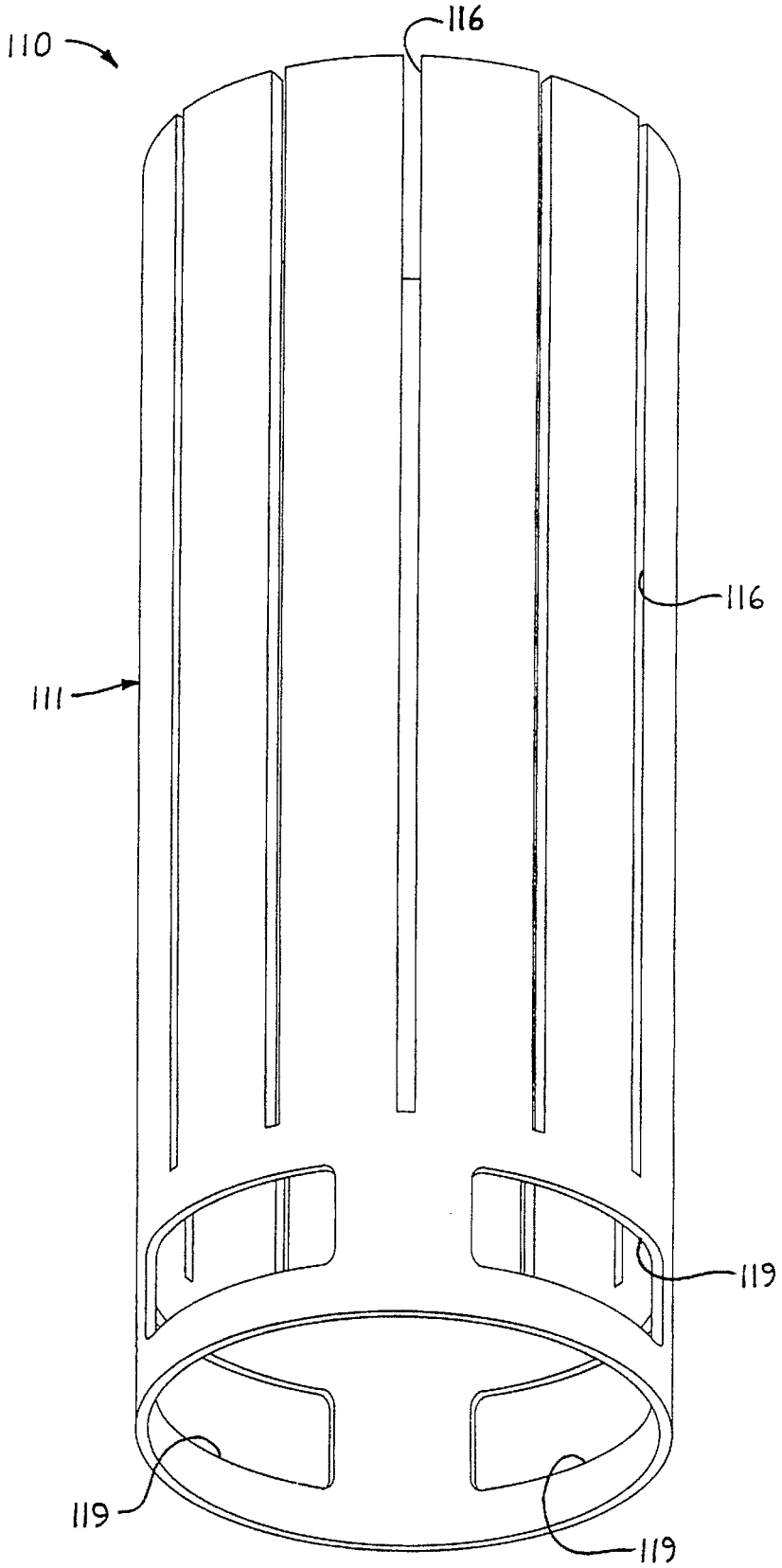
FIG. 13 is a perspective view of a hand-held version of a storage rack in accordance with the present invention.

FIG. 13 shows an alternative hand-held embodiment of a storage rack 110 of the present invention. Storage rack 110 may be formed of two parts, as in the first embodiment, or may be constructed as a single piece from plastic or other suitable materials, such as cardboard. Storage rack 110 includes a tubular body 111, with a plurality of longitudinal slots 116 opening at one end. The opposite end of storage rack 110 includes a plurality of generally oval-shaped openings 119 which serve as hand gripping means.

String lighting may be installed upon hand-held storage rack 110 in a manner similar to the base-mounted version of the storage rack described above. Storage rack 110 may be gripped in one hand by openings 119 or placed upright or at an angle on the ground. Light bulbs 46 may then be successively loaded onto or unloaded from storage rack 110 as described above, either into adjacent slots 116, or by skipping one or more slots 116 to take up additional slack in cord 50.

While a preferred embodiment of a light string storage rack and method of storage in accordance with the present invention has been set forth fully and completely hereinabove, it will be apparent to one of skill in the art that a number of other changes may be made in, for example, the shape and appearance of the rack body, the size and spacing of the slots, and the like, without departing from the true spirit and scope of the present invention which is accordingly to be limited only by the following claims.

What is claimed is:

1. A method for storing string lighting, said method comprising;

providing a tubular body having a first end and a second end, said tubular body having a plurality of longitudinal slots opening on at least one end; and successively disposing light bulbs from a string of lights on said tubular body by placing light bulbs in said longitudinal slots so that a cord between any two bulbs of a string of lights extends between two of said longitudinal slots.

2. The method according to claim 1 wherein said tubular body is rotatably mounted on a base, and said tubular body is rotated to present successive slots as light bulbs of a string of lights are successively inserted into said slots.

3. The method according to claim 1 wherein said tubular body includes a hand grip means, and said tubular body is gripped by one hand while light bulbs are placed into said slots of said tubular body.

4. A method of storing a light string, said method comprising:

providing a tubular body having a first end and a second end, and having a plurality of longitudinal slots open at least at said first end thereof, said tubular body having an interior and an exterior;

placing a first light bulb from a light string into a first of said longitudinal slots so that said light bulb is within said interior of said tubular body and a cord from a light string extends through said first longitudinal slot to said exterior of said tubular body; and placing succeeding light bulbs in succeeding longitudinal slots so that some slack in a cord of a light string is taken up by the distance between said longitudinal slots when light bulbs from a string of lights are disposed in said longitudinal slots of said tubular body.

5. The method of claim 4 wherein said tubular body is rotatably mounted on a base, and said tubular body is rotated on said base while a string of lights is being loaded onto said tubular body.

6. The method of claim 4 wherein said tubular body includes a hand gripping means, and said tubular body is gripped by a user's hand while light bulbs are inserted into said slots of said tubular body.

7. A storage rack for storing string lighting, said storage rack comprising:

a tubular body having a first end and a second end, said tubular body having a plurality of longitudinal slots opening at least at said first end, said slots being of sufficient width to receive at least a cord of a string of lights; and a hand gripping means associated with said tubular body for enabling a user to grasp said tubular body with one hand while loading a string of lights on said tubular body or removing a string of lights therefrom.

8. The storage rack of claim 7 wherein said hand gripping means comprises at least one opening formed in said second end of said tubular body.

9. The storage rack of claim 7 wherein said storage rack is molded from plastic.

10. The storage rack of claim 7 wherein said storage rack is constructed from cardboard.

11. The storage rack of claim 7 wherein said tubular body is cylindrical.

12. A storage rack for receiving and storing string lighting, said storage rack comprising:

a tubular body having a first end and a second end, said tubular body having a plurality of longitudinal slots opening at least at said first end, said slots being of sufficient width to receive at least a cord from a string of lights; and a base for supporting said tubular body, said tubular body being mounted on said base in such a manner as to permit free rotation of said tubular body relative to said base.

13. The storage rack of claim 12 wherein said tubular body is formed by assembling a first rack half to a second rack half, said first rack half being generally identical to said second rack half.

14. The storage rack of claim 12 wherein said tubular body is cylindrical.

15. The storage rack of claim 12 wherein said tubular body is molded from plastic.

16. The storage rack of claim 12 wherein said tubular body is constructed from cardboard.

17. The storage rack of claim 17 wherein said tubular body includes a bottom wall adjacent said second end, said bottom wall having a central opening for attaching said tubular body to said base.

18. The storage rack of claim 22 wherein said tubular body is retained on said base by a cap passing through said central opening, said cap having a flange larger than said central opening, and which said flange overlaps said bottom wall for retaining said tubular body on said base so as to permit rotation.

* * * * *